US009367000B2

(12) United States Patent
Watanabe et al.

(10) Patent No.: US 9,367,000 B2
(45) Date of Patent: Jun. 14, 2016

(54) TRANSFER DEVICE AND IMAGE FORMING APPARATUS FOR TRANSFERRING METALLIC TONER PARTICLES

(71) Applicant: FUJI XEROX CO., LTD, Tokyo (JP)

(72) Inventors: Sho Watanabe, Kanagawa (JP); Yoshiyuki Tominaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/466,483

(22) Filed: Aug. 22, 2014

(65) Prior Publication Data

US 2015/0198914 A1 Jul. 16, 2015

(30) Foreign Application Priority Data

Jan. 15, 2014 (JP) ..... 2014-005185

(51) Int. Cl.
*G03G 15/16* (2006.01)

(52) U.S. Cl.
CPC ..... *G03G 15/1685* (2013.01); *G03G 15/1605* (2013.01)

(58) Field of Classification Search
CPC ..... G03G 9/0902
See application file for complete search history.

(56) References Cited

U.S. PATENT DOCUMENTS 7,029,810 B2 * 4/2006 Toda et al. ..... 430/58.7
9,002,227 B2 * 4/2015 Ohno ..... G03G 15/80 399/101
9,046,861 B2 * 6/2015 Ohno ..... G03G 15/80
2003/0185601 A1 * 10/2003 Toyohara et al. ..... 399/298
2005/0105927 A1 * 5/2005 Kayahara ..... 399/49
2005/0232663 A1 * 10/2005 Shimura et al. ..... 399/315
2005/0244190 A1 * 11/2005 Omata et al. ..... 399/121
2006/0198665 A1 * 9/2006 Hamada ..... G03G 15/168 399/296
2006/0269330 A1 * 11/2006 Toyohara ..... 399/227
2007/0128531 A1 * 6/2007 Schultheis et al. ..... 430/108.23
2007/0217832 A1 * 9/2007 Oyama ..... G03G 15/161 399/302
2008/0240788 A1 * 10/2008 Mashtare et al. ..... 399/223
2008/0247782 A1 * 10/2008 Sato ..... G03G 15/169 399/99

(Continued)

FOREIGN PATENT DOCUMENTS

JP 10177286 A 6/1998
JP 2001183916 A * 7/2001 ..... G03G 15/16

(Continued)

OTHER PUBLICATIONS

English translation of Communication dated Oct. 21, 2014, issued by the Japan Patent Office in corresponding Japanese Application No. 2014-005185.

*Primary Examiner* — David Bolduc
(74) *Attorney, Agent, or Firm* — Sughrue Mion, PLLC

(57) ABSTRACT

A transfer device includes a transfer body having an endless structure and to which an image is transferred while the transfer body is rotated; a first transfer portion that transfers an image formed with toner containing metallic pigment to a surface of the transfer body by applying a transfer current; a second transfer portion that is disposed on the upstream side of the first transfer portion in the rotation direction of the transfer body and transfers an image formed with toner not containing metallic pigment to the surface of the transfer body by applying a transfer current; and a support member that is grounded and disposed on the downstream side of the first transfer portion in the rotation direction of the transfer body, the support member being in contact with the back surface of the transfer body to support the transfer body.

14 Claims, 8 Drawing Sheets

(56) References Cited

U.S. PATENT DOCUMENTS

2009/0111040 A1* 4/2009 Veregin et al. ..... 430/108.3
2009/0129831 A1* 5/2009 Sakashita et al. ..... 399/309
2009/0154948 A1* 6/2009 Cahill et al. ..... 399/69
2009/0220880 A1* 9/2009 Moffat et al. ..... 430/108.6
2010/0061739 A1* 3/2010 Yang ..... 399/2
2010/0189456 A1* 7/2010 Jung ..... G03G 15/1675 399/66
2011/0017834 A1* 1/2011 Schulze-Hagenest et al. ..... 235/492
2011/0073356 A1* 3/2011 Suchy et al. ..... 174/257
2011/0116812 A1* 5/2011 Shifley ..... 399/16
2011/0116814 A1* 5/2011 Shifley et al. ..... 399/24
2011/0116838 A1* 5/2011 Shifley et al. ..... 399/223
2011/0116840 A1* 5/2011 Tombs et al. ..... 399/224
2011/0116845 A1* 5/2011 Shifley et al. ..... 399/299
2011/0117487 A1* 5/2011 Shifley et al. ..... 430/124.1
2011/0221805 A1* 9/2011 Yoshida ..... B41J 2/2107 347/9
2011/0249992 A1 10/2011 Yoshida
2012/0045231 A1* 2/2012 Ogino ..... G03G 15/1605 399/45
2012/0045236 A1* 2/2012 Fukamachi ..... 399/53
2012/0207515 A1* 8/2012 Tombs et al. ..... 399/223
2013/0022373 A1* 1/2013 Bucks et al. ..... 399/256
2013/0148993 A1 6/2013 Aoki et al.
2013/0188980 A1* 7/2013 Ito et al. ..... 399/88
2013/0188981 A1* 7/2013 Horiguchi et al. ..... 399/88
2013/0195519 A1* 8/2013 Ito et al. ..... 399/314
2013/0295504 A1* 11/2013 Tyagi et al. ..... 430/137.21
2013/0323633 A1* 12/2013 Takahashi et al. ..... 430/105
2014/0029966 A1* 1/2014 Kojiri ..... 399/67
2014/0043623 A1* 2/2014 Koyatsu ..... G03G 15/6585 358/1.1
2014/0043625 A1* 2/2014 Koyatsu ..... G06K 15/18 358/1.9
2014/0045113 A1* 2/2014 Takahashi et al. ..... 430/105
2014/0147146 A1* 5/2014 Kobayashi ..... G03G 15/161 399/66
2014/0147149 A1* 5/2014 Kiuchi ..... 399/68
2014/0161494 A1* 6/2014 Ishizumi ..... G03G 15/0189 399/301
2014/0356008 A1* 12/2014 Harashima et al. ..... 399/69
2015/0078769 A1* 3/2015 Kogusuri ..... 399/39
2015/0098719 A1* 4/2015 Ishizumi ..... G03G 15/161 399/49

FOREIGN PATENT DOCUMENTS

JP 2001356559 A 12/2001
JP 2006308673 A 11/2006
JP 2008020782 A 1/2008
JP 2011-232729 A 11/2011
JP 2012-185292 A 9/2012
JP 2012-247470 A 12/2012
JP 2013125053 A 6/2013

* cited by examiner

TRANSFER DEVICE AND IMAGE FORMING APPARATUS FOR TRANSFERRING METALLIC TONER PARTICLES

CROSS-REFERENCE TO RELATED APPLICATIONS

This application is based on and claims priority under 35 USC 119 from Japanese Patent Application No. 2014-005185 filed Jan. 15, 2014.

BACKGROUND

Technical Field

The present invention relates to a transfer device and an image forming apparatus.

SUMMARY

According to an aspect of the invention, there is provided a transfer device including a transfer body having an endless structure and to which an image is transferred while the transfer body is rotated; a first transfer portion that transfers an image formed with toner containing metallic pigment to a surface of the transfer body by applying a transfer current; a second transfer portion that is disposed on the upstream side of the first transfer portion in the rotation direction of the transfer body and transfers an image formed with toner not containing metallic pigment to the surface of the transfer body by applying a transfer current; and a support member that is grounded and disposed on the downstream side of the first transfer portion in the rotation direction of the transfer body, the support member being in contact with the back surface of the transfer body to support the transfer body.

BRIEF DESCRIPTION OF THE DRAWINGS

Exemplary embodiments of the present invention will be described in detail based on the following figures, wherein.

DETAILED DESCRIPTION

First Exemplary Embodiment

An example of a transfer device and image forming apparatus according to a first exemplary embodiment of the present invention will be described below with reference to FIGS. 1A to 6. Note that, in the respective drawings, the arrow H indicates the vertical direction, which corresponds to the height direction of the apparatus, and the arrow W indicates the horizontal direction, which corresponds to the width direction of the apparatus.

Overall Configuration of Image Forming Apparatus

Figure 6:
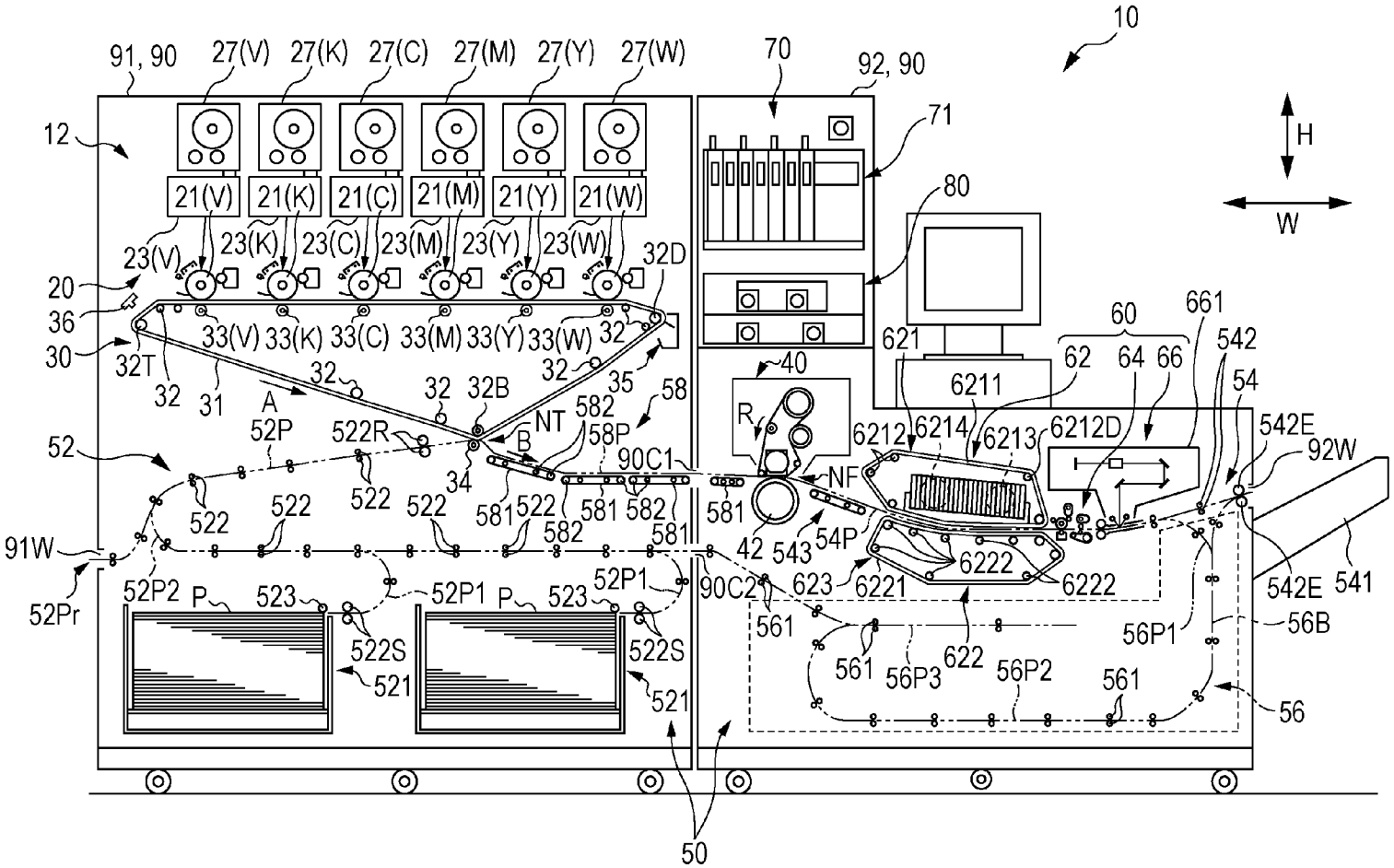
FIG. 6 is a schematic diagram showing the configuration of the image forming apparatus according to the first exemplary embodiment of the present invention.

FIG. 6 is a schematic diagram showing the overall configuration of an image forming apparatus 10, as viewed from the front. As shown in FIG. 6, the image forming apparatus 10 includes an image forming section 12 that forms an image on a sheet member P, serving as a recording medium, by using electrophotographic system; a medium transport device 50 that transports the sheet member P; and a post-processing section 60 that performs post-processing etc. on the sheet member P on which an image has been formed.

The image forming apparatus 10 further includes a controller 70 that controls the above-mentioned devices and sections and a power supply unit 80 described below, and a power supply unit 80 that supplies power to the above-mentioned devices and sections, including the controller 70.

Furthermore, the image forming section 12 includes toner-image forming sections 20 that form toner images, a transfer device 30 that transfers the toner images formed in the toner-image forming sections 20 to a sheet member P, and a fixing device 40 that fixes the toner image transferred to the sheet member P onto the sheet member P.

The medium transport device 50 includes a medium feeding portion 52 that supplies a sheet member P to the image forming section 12, and a medium discharge portion 54 that discharges the sheet member P having a toner image formed thereon. The medium transport device 50 further includes a medium returning portion 56 that is used when an image is formed on each side of the sheet member P, and an intermediate transport portion 58 described below.

The post-processing section 60 includes a medium cooling unit 62 that cools a sheet member P to which a toner image has been transferred in the image forming section 12, a straightening device 64 that straightens a curled sheet member P, and an image inspection portion 66 that inspects an image formed on the sheet member P. The components of the post-processing section 60 are disposed in the medium discharge portion 54 of the medium transport device 50.

The components of the image forming apparatus 10, except for a discharged-medium receiving portion 541 constituting the medium discharge portion 54 of the medium transport device 50, are accommodated in a housing 90. The housing 90 according to this exemplary embodiment is separated into two parts, namely, a first housing 91 and a second housing 92, which are side-by-side in the apparatus width direction. This configuration contributes to a reduction in the transportation unit of the image forming apparatus 10 in the apparatus width direction.

The first housing 91 accommodates the principal part of the image forming section 12, except for the fixing device 40 described below, and the medium feeding portion 52. The second housing 92 accommodates the fixing device 40, which constitutes the image forming section 12; the medium discharge portion 54, except for the discharged-medium receiving portion 541; the medium cooling unit 62; the image inspection portion 66; the medium returning portion 56; the controller 70; and the power supply unit 80. The first housing 91 and the second housing 92 are coupled together with fastening members, such as bolts and nuts (not shown). A communication opening 90C1, through which a sheet member P is transported from a transfer nip NT in the image forming section 12 to a fixing nip NF (described below), and a communication path 90C2, through which the sheet member P is transported from the medium returning portion 56 to the medium feeding portion 52, are provided between the first housing 91 and the second housing 92 that are coupled together.

Image Forming Section

As has been described above, the image forming section 12 includes the toner-image forming sections 20, the transfer device 30, and the fixing device 40. There are multiple toner-image forming sections 20 so that toner images of different colors are formed. In this exemplary embodiment, six toner-image forming sections 20 are provided corresponding to a first special color (V), a second special color (W), yellow (Y), magenta (M), cyan (C), and black (K). The letters (V), (W), (Y), (M), (C), and (K) shown in FIG. 6 indicate the above-mentioned colors. The transfer device 30 transfers six colors of toner images from the transfer belt 31, which is an example of a transfer body and to which the six colors of toner images have been first-transferred in a superposed manner, to a sheet member P at the transfer nip NT (a detailed description will be given below).

In this exemplary embodiment, the first special color (V) is, for example, silver, which uses toner containing flat pigment for adding metallic shine to an image. The second special color (W) is a corporate color specific to a user, which is more frequently used than the other colors. Details of the silver toner and the control of the respective portions by the controller 70 when an image is to be formed using the silver toner will be described below.

Toner-Image Forming Section

Figure 2:
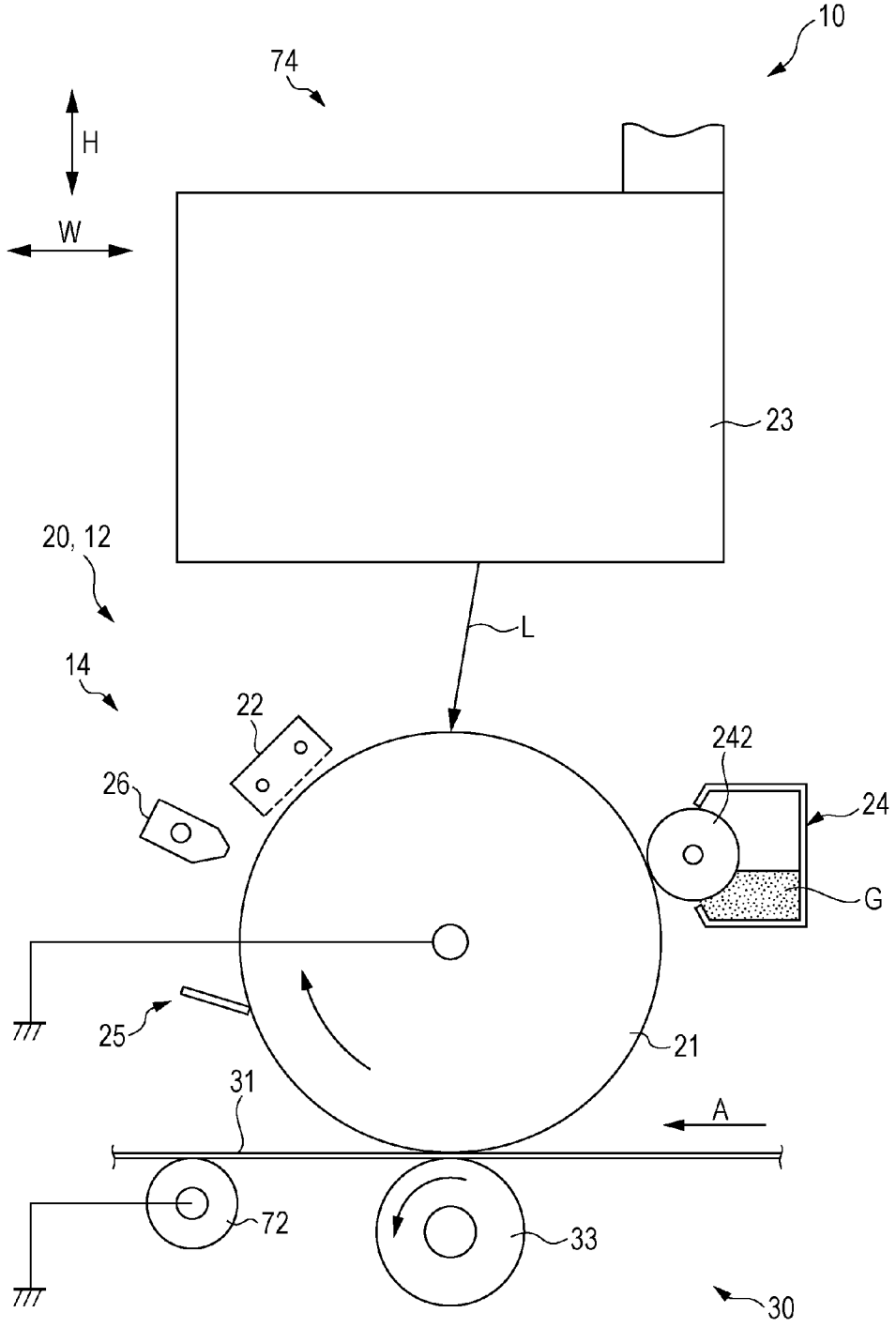
FIG. 2 is a diagram showing the configuration of a transfer portion etc. of the transfer device according to the first exemplary embodiment of the present invention.

The toner-image forming sections 20 for the respective colors basically have the same configuration, except for the toners they use. Therefore, image forming units 14 for the respective colors will be described below without distinction. As shown in FIG. 2, each image forming unit 14 of the toner-image forming section 20 includes a photoconductor drum 21, which is an example of an image carrier; a charger 22; an exposure device 23; a developing device 24, which is an example of a developing unit; a cleaning device 25; and a static eliminator 26.

Photoconductor Drum

The photoconductor drum 21 is formed in a cylindrical shape, is grounded, and is rotated about its own shaft by a driving device (not shown). The photoconductor drum 21 has, for example, a negatively charged photosensitive layer on the surface thereof. As shown in FIG. 6, the photoconductor drums 21 for the respective colors are arranged in a straight line in the apparatus width direction, as viewed from the front.

Charger

As shown in FIG. 2, the charger 22 negatively charges the surface (photosensitive layer) of the photoconductor drum 21. In this exemplary embodiment, the charger 22 is a scorotron charger of a corona discharge type (non-contact charging type).

Exposure Device

The exposure device 23 forms an electrostatic latent image on the surface of the photoconductor drum 21. More specifically, the exposure device 23 radiates modulated exposure light L to the surface of the photoconductor drum 21 that has been charged by the charger 22, according to image data received from an image signal processing portion 71 (see FIG. 6) constituting the controller 70. Due to the radiation of the exposure light L by the exposure device 23, an electrostatic latent image is formed on the surface of the photoconductor drum 21.

Developing Device

The developing device 24 develops the electrostatic latent image formed on the surface of the photoconductor drum 21 with developer G containing toner, thereby forming a toner image on the surface of the photoconductor drum 21. The toner is supplied from a toner cartridge 27, which contains the toner, to the developing device 24.

Cleaning Device

The cleaning device 25 is blade-shaped so that it scrapes off the toner remaining on the surface of the photoconductor drum 21 after the toner image has been transferred to the transfer device 30.

Static Eliminator

The static eliminator 26 removes static electricity by radiating light to the photoconductor drum 21 after the transfer. Thus, the charging history on the surface of the photoconductor drum 21 is deleted.

Transfer Device

The transfer device 30 first-transfers toner images on the photoconductor drums 21 for the respective colors to the transfer belt 31 in a superposed manner, and then second-transfers the superposed toner image to a sheet member P. A detailed description will be given below.

Transfer Belt

Figure 5:
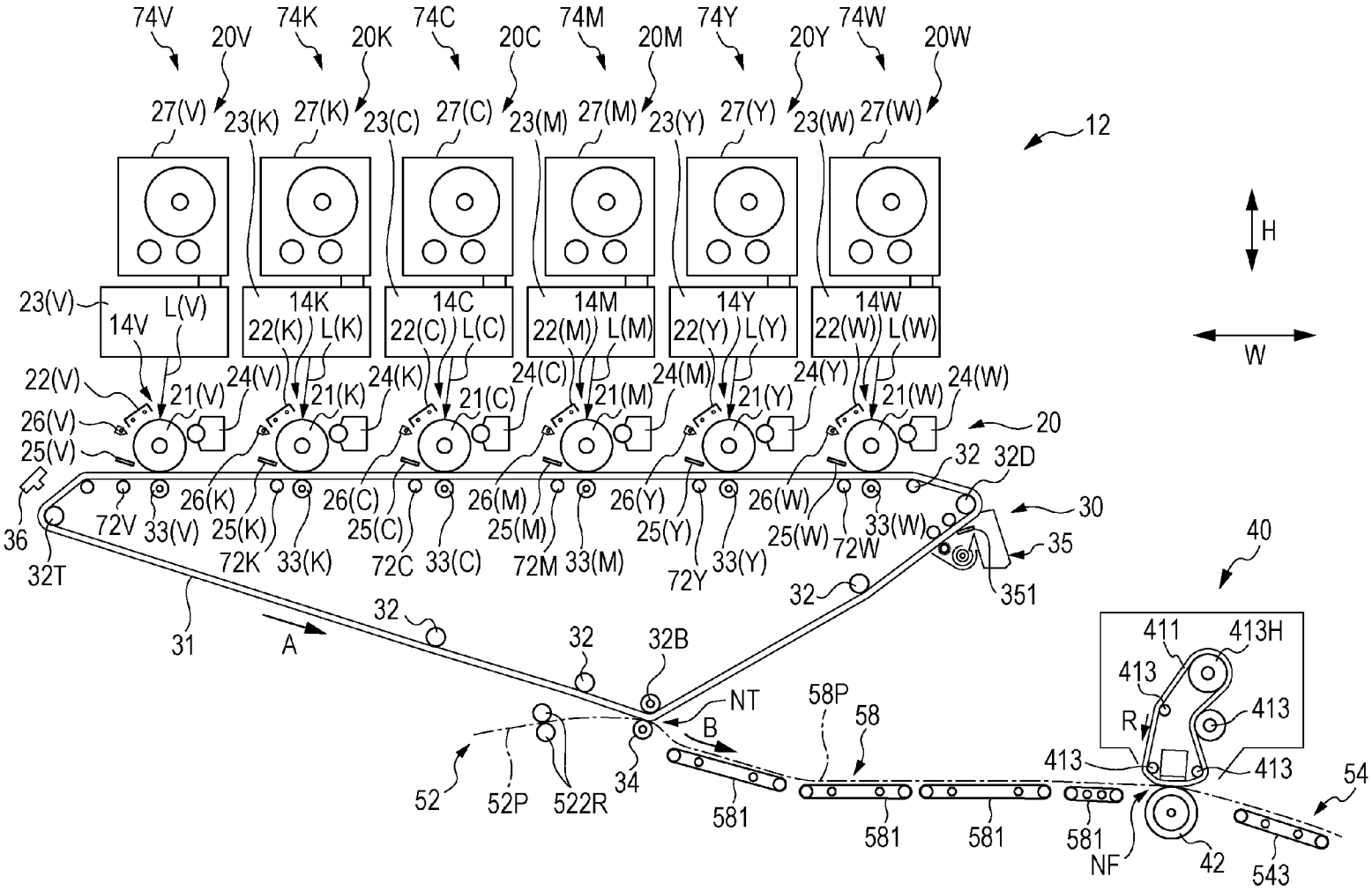
FIG. 5 is a diagram showing the configuration of an image forming section of the image forming apparatus according to the first exemplary embodiment of the present invention.

As shown in FIG. 5, the transfer belt 31 is an endless belt wound around multiple rollers 32 so as to be held in a certain orientation. In this exemplary embodiment, the transfer belt 31 is held in an inverted obtuse triangular orientation elongated in the apparatus width direction in front view. Of the multiple rollers 32, a roller 32D shown in FIG. 5 serves as a driving roller that drives the transfer belt 31 in an arrow A direction, using the power supplied by a motor (not shown).

Furthermore, of the multiple rollers 32, a roller 32T shown in FIG. 5 serves as a tension roller that applies tension to the transfer belt 31. Of the multiple rollers 32, a roller 32B shown in FIG. 5 serves as an opposing roller for a second transfer roller 34 (described below). The lower apex portion of the transfer belt 31, which is held in an inverted obtuse triangular orientation as described above, is wound around this roller 32B. The surface of the transfer belt 31 is in contact with the photoconductor drums 21 for the respective colors from below, at the upper peripheral portion extending in the apparatus width direction in the above-described orientation.

First Transfer Roller

First transfer rollers 33, which are an example of a transfer member, that transfer toner images on the respective photoconductor drums 21 to the transfer belt 31 are arranged inside the transfer belt 31. The first transfer rollers 33 are disposed so as to oppose the corresponding photoconductor drums 21 with the transfer belt 31 therebetween. Furthermore, a power supply portion (not shown) applies a transfer bias voltage (positive voltage) of an opposite polarity to the polarity of the toner (in this exemplary embodiment, for example, negative) to the first transfer rollers 33. Due to the application of this transfer bias voltage, the toner images formed on the photoconductor drums 21 are transferred to the transfer belt 31.

As has been described above, a transfer portion 74V, which is an example of a first transfer portion, that transfers an image formed with toner containing flat metallic pigment to the transfer belt 31 by applying a transfer current includes a first transfer roller 33V. Furthermore, transfer portions 74K, 74C, 74M, 74Y, and 74W, which are an example of a second transfer portion, that transfer images formed with toner not containing flat metallic pigment to the transfer belt 31 by applying a transfer current include the first transfer rollers 33K, 33C, 33M, 33Y, and 33W, respectively.

Second Transfer Roller

Furthermore, the transfer device 30 includes the second transfer roller 34 that transfers a superposed toner image formed on the transfer belt 31 to a sheet member P. The second transfer roller 34 is arranged to face the roller 32B with the transfer belt 31 therebetween, forming the transfer nip NT between the second transfer roller 34 and the transfer belt 31. Sheet members P are fed from the medium feeding portion 52 to this transfer nip NT at appropriate timing. A power supply portion (not shown) applies a transfer bias voltage (positive voltage) having an opposite polarity to the polarity of the toner to the second transfer roller 34. Due to the application of this transfer bias voltage, the toner image is transferred from the transfer belt 31 to the sheet member P passing through the transfer nip NT.

Cleaning Device

The transfer device 30 further includes a cleaning device 35 that cleans the transfer belt 31 after the second transfer. The cleaning device 35 is disposed on the downstream side of the position where the second transfer is performed (transfer nip NT) and on the upstream side of the position where the first transfer is performed, in the rotation direction of the transfer belt 31. The cleaning device 35 includes a blade 351 that scrapes off the toner remaining on the surface of the transfer belt 31.

Furthermore, a static eliminator (not shown) that removes static electricity from the transfer belt 31 is provided next to the cleaning device 35.

Fixing Device

The fixing device 40 fixes a toner image transferred to a sheet member P in the transfer device 30 onto the sheet member P. In this exemplary embodiment, the fixing device 40 fixes the toner image onto the sheet member P by applying pressure while heating the toner image at the fixing nip NF, which is formed between a fixing belt 411 wound around multiple rollers 413 and a pressure roller 42. Note that a roller 413H is a heating roller that accommodates, for example, a heater therein and is rotated by a driving force transmitted from a motor (not shown). Thus, the fixing belt 411 is rotated in an arrow R direction.

The pressure roller 42 is also rotated by a driving force transmitted from a motor (not shown), at the same peripheral velocity as the fixing belt 411. The fixing temperature, fixing pressure, and fixing time etc. of the fixing device 40 controlled by the controller 70 will be described in detail below.

Medium Transport Device

As shown in FIG. 6, the medium transport device 50 includes the medium feeding portion 52, the medium discharge portion 54, the medium returning portion 56, and the intermediate transport portion 58.

Medium Feeding Portion

The medium feeding portion 52 includes containers 521 in which a stack of sheet members P is stored. In this exemplary embodiment, two containers 521 are arranged side-by-side in the apparatus width direction, below the transfer device 30.

Medium supply paths 52P extending from the containers 521 to the transfer nip NT (second transfer position) are formed by multiple transport roller pairs 522 and guides (not shown), etc. Each medium supply path 52P is bent in the apparatus width direction at two bent portions 52P1 and 52P2 and extends upward to the transfer nip NT, forming a substantially S shape.

Feeding rollers 523 that feed the top sheets of the sheet members P stored in the containers 521 are provided above the containers 521. Among the multiple transport roller pairs 522, transport roller pairs 522S located on the most upstream side in the sheet transport direction serve as separation rollers that separate the sheet members P fed in a stacked manner from the containers 521 by the feeding rollers 523 into individual sheet members P. Furthermore, among the multiple transport roller pairs 522, a transport roller pair 522R located immediately upstream of the transfer nip NT in the sheet transport direction is operated so as to match the timing of transporting a toner image on the transfer belt 31 and the timing of transporting a sheet member P.

The medium feeding portion 52 further includes an auxiliary transport path 52Pr. The auxiliary transport path 52Pr extends from an opening 91W provided in a wall of the first housing 91 opposite from a wall adjacent to the second housing 92 and joins the bent portion 52P2 of the medium supply path 52P. The auxiliary transport path 52Pr is a transport path that is used to feed a sheet member P, fed from an optional recording medium feeding device (not shown) provided adjacent to the opening 91W in the first housing 91, to the image forming section 12.

Intermediate Transport Portion

As shown in FIG. 5, the intermediate transport portion 58 is disposed between the transfer nip NT in the transfer device 30 and the fixing nip NF in the fixing device 40 and includes multiple belt transport members 581 each formed of an endless transport belt wound around rollers.

The transport members 581 transport a sheet member P by rotating the transport belts, while sucking air (negative pressure suction) from the inside to make the sheet member P adhere to the surfaces of the transport belts.

Medium Discharge Portion

As shown in FIG. 6, the medium discharge portion 54 discharges a sheet member P onto which a toner image has been fixed by the fixing device 40 in the image forming section 12 to the outside of the housing 90 from a discharge port 92W provided in a wall of the second housing 92 opposite from a wall adjacent to the first housing 91.

The medium discharge portion 54 includes the discharged-medium receiving portion 541 that receives the sheet member P discharged from the discharge port 92W.

The medium discharge portion 54 includes a medium discharge path 54P along which a sheet member P is transported from the fixing device 40 (fixing nip NF) to the discharge port 92W. The medium discharge path 54P includes a belt transport member 543, multiple roller pairs 542, and guides (not shown) etc. Among the multiple roller pairs 542, a roller pair 542E that is disposed on the most downstream side in a sheet discharge direction serves as discharge rollers that discharge the sheet member P onto the discharged-medium receiving portion 541.

Medium Returning Portion

The medium returning portion 56 includes multiple roller pairs 561. The multiple roller pairs 561 form a reversing path 56P into which a sheet member P having passed through the image inspection portion 66 is fed when an image is to be formed also on the other side of the sheet member P. The reversing path 56P includes a diverging path 56P1, a transport path 56P2, and a reversing path 56P3. The diverging path 56P1 diverges from the medium discharge path 54P. The transport path 56P2 sends a sheet member P received from the diverging path 56P1 into the medium supply path 52P. The reversing path 56P3 is provided at an intermediate position of the transport path 56P2 and reverses a sheet member P by changing the direction in which the sheet member P is transported along the transport path 56P2 (i.e., switchback transportation).

Post-Processing Section

The medium cooling unit 62, the straightening device 64, and the image inspection portion 66, which constitute the post-processing section 60, are arranged on the upstream side, in the sheet discharge direction, of a diverging portion of the diverging path 56P1 of the medium discharge path 54P of the medium discharge portion 54, in sequence from the upstream side in the discharge direction.

Medium Cooling Unit

The medium cooling unit 62 includes a heat-absorbing device 621 that absorbs the heat of a sheet member P, and a pressing device 622 that presses the sheet member P onto the heat-absorbing device 621. The heat-absorbing device 621 is disposed above the medium discharge path 54P, and the pressing device 622 is disposed below the medium discharge path 54P.

The heat-absorbing device 621 includes an endless heat-absorbing belt 6211, multiple rollers 6212 that support the heat-absorbing belt 6211, a heat sink 6213 disposed inside the heat-absorbing belt 6211, and a fan 6214 for cooling the heat sink 6213.

The heat-absorbing belt 6211 is in contact with the sheet member P at the outer circumferential surface thereof so as to be able to exchange heat. Among the multiple rollers 6212, a roller 6212D serves as a driving roller that transmits a driving force to the heat-absorbing belt 6211. The heat sink 6213 is in sliding contact with the inner circumferential surface of the heat-absorbing belt 6211, over a predetermined area along the medium discharge path 54P.

The pressing device 622 includes an endless pressing belt 6221 and multiple rollers 6222 that support the pressing belt 6221. The pressing belt 6221 is wound around the multiple rollers 6222. The pressing device 622 transports the sheet member P in cooperation with the heat-absorbing belt 6211 by pressing the sheet member P onto the heat-absorbing belt 6211 (heat sink 6213).

Straightening Device

The straightening device 64 is provided on the downstream side of the medium cooling unit 62 in the medium discharge portion 54. The straightening device 64 straightens a curled sheet member P received from the medium cooling unit 62.

Image Inspection Portion

An in-line sensor 661, which constitutes the principal part of the image inspection portion 66, is disposed on the downstream side of the straightening device 64 in the medium discharge portion 54. The in-line sensor 661 detects the presence/absence and level of toner intensity defect, image defect, image position defect, etc. in a fixed toner image, on the basis of light emitted to and reflected from the sheet member P.

Image Forming Operation (Action) of Image Forming Apparatus

Next, the outline of an image forming process and subsequent post-processing process performed on a sheet member P by the image forming apparatus 10 will be described.

As shown in FIG. 6, upon receipt of an image forming instruction, the controller 70 activates the toner-image forming sections 20, the transfer device 30, and the fixing device 40. As a result, as shown in FIG. 5, the photoconductor drums 21 and developing rollers 242 of the developing devices 24 of the image forming units 14 for the respective colors are rotated, and the transfer belt 31 is rotated. Furthermore, the pressure roller 42 is rotated, and the fixing belt 411 is rotated. In synchronization with these operations, the controller 70 activates the medium transport device 50 etc.

As a result, the photoconductor drums 21 for the respective colors are charged by the chargers 22 while being rotated. Furthermore, the controller 70 sends image data processed by the image signal processing portion to the exposure devices 23. The exposure devices 23 emit exposure light L according to the image data to expose the charged photoconductor drums 21. As a result, electrostatic latent images are formed on the surfaces of the photoconductor drums 21. The electrostatic latent images formed on the respective photoconductor drums 21 are developed with developer supplied from the developing devices 24. In this way, toner images of the first special color (V), second special color (W), yellow (Y), magenta (M), cyan (C), and black (K) are formed on the corresponding photoconductor drums 21 for the respective colors.

The toner images of the respective colors, formed on the photoconductor drums 21 for the respective colors, are sequentially transferred to the rotating transfer belt 31 due to the application of transfer bias voltages via the first transfer rollers 33 for the respective colors.

More specifically, transfer bias voltages are applied to the first transfer rollers 33, and transfer currents flow from the first transfer rollers 33 to the photoconductor drums 21. Then, the transfer belt 31 is positively charged, and toner images formed of negatively charged toner are transferred to the transfer belt 31.

In this manner, a superposed toner image, in which six colors of toner images are superposed on one another, is formed on the transfer belt 31. This superposed toner image is transported to the transfer nip NT by the rotating transfer belt 31.

As shown in FIG. 6, the transport roller pair 522R of the medium feeding portion 52 feeds a sheet member P to the transfer nip NT at the same time when the superposed toner image is transported thereto. When a transfer bias voltage is applied at the transfer nip NT, the superposed toner image is transferred from the transfer belt 31 to the sheet member P.

The sheet member P to which the toner image has been transferred is transported from the transfer nip NT in the transfer device 30 to the fixing nip NF in the fixing device 40 by the intermediate transport portion 58. The fixing device 40 applies heat and pressure to the sheet member P passing through the fixing nip NF. As a result, the toner image transferred to the sheet member P is fixed.

The sheet member P discharged from the fixing device 40 is transported toward the discharged-medium receiving portion 541 outside the apparatus by the medium discharge portion 54, while being processed by the post-processing section 60. The sheet member P heated in the fixing process is first cooled by the medium cooling unit 62. Then, the sheet member P is straightened by the straightening device 64. Then, the toner image fixed to the sheet member P is inspected by the image inspection portion 66 for the presence/absence and level of toner intensity defect, image defect, image position defect, etc. Finally, the sheet member P is discharged onto the medium discharge portion 54.

On the other hand, when an image is to be formed on a non-image surface (a surface on which no image is formed) of the sheet member P (i.e., when double-sided printing is to be performed), the controller 70 switches the transport path for the sheet member P after passing the image inspection portion 66 from the medium discharge path 54P of the medium discharge portion 54 to the diverging path 56P1 of the medium returning portion 56. By doing so, the sheet member P is reversed via the reversing path 56P and is sent to the medium supply path 52P. An image is formed (fixed) on the back surface of the sheet member P through the same process as the image forming process performed on the front surface. Then, the sheet member P goes through the same process as that performed on the front surface after image formation and is discharged onto the discharged-medium receiving portion 541 outside the apparatus by the medium discharge portion 54.

Configuration of Relevant Part

Next, the position of the transfer portions 74 for the respective colors, silver toner particles 112 used as the first special color (V), etc. will be described.

Position of Transfer Portion

As shown in FIG. 5, the transfer portions 74 for colors other than silver (hereinbelow, simply "other colors") are arranged on the upstream side of the transfer portion 74V for silver, in the rotation direction of the transfer belt 3. In other words, the transfer portion 74V for silver is located on the most downstream side of all the transfer portions 74, in the rotation direction of the transfer belt 31.

Silver Toner

Figure 1A:
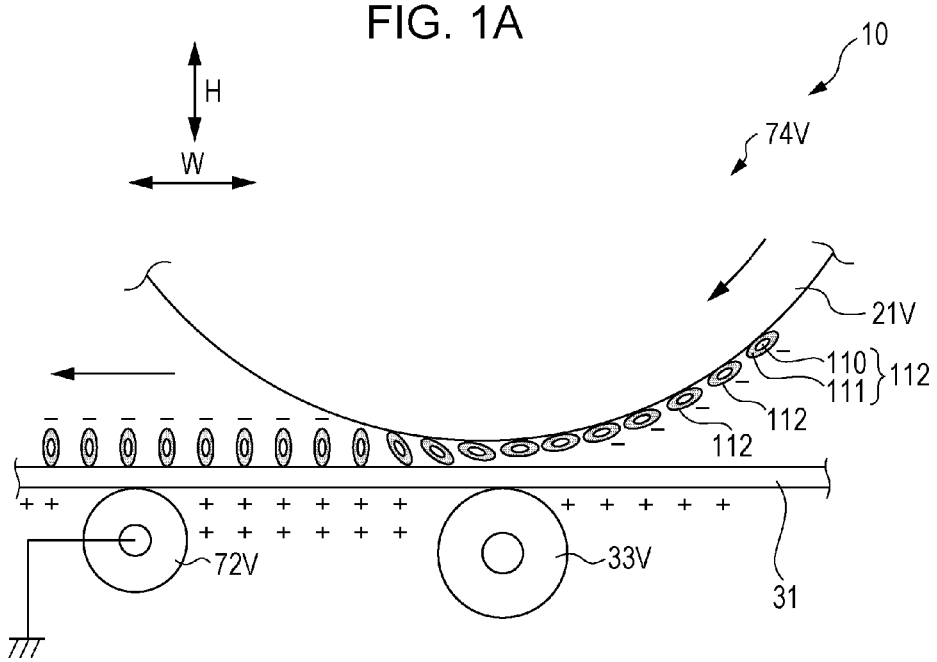
FIGS. 1A and 1B are front views showing the vicinity of a grounded roller of a transfer device according to a first exemplary embodiment of the present invention.

As shown in FIG. 1A, silver toner particles 112 used as the first special color (V) each are composed of pigment 110, which is an example of flat metallic pigment, and binder resin 111 covering the pigment 110. Thus, the toner particles 112 are also flat. The toner particles 112 are used to add metallic shine to an image.

The pigment 110 is formed of aluminum. If the pigment 110 placed on a flat surface is viewed from the side, as shown in FIG. 4B, the pigment 110 is larger in the horizontal direction than in the height direction.

Figure 4A:
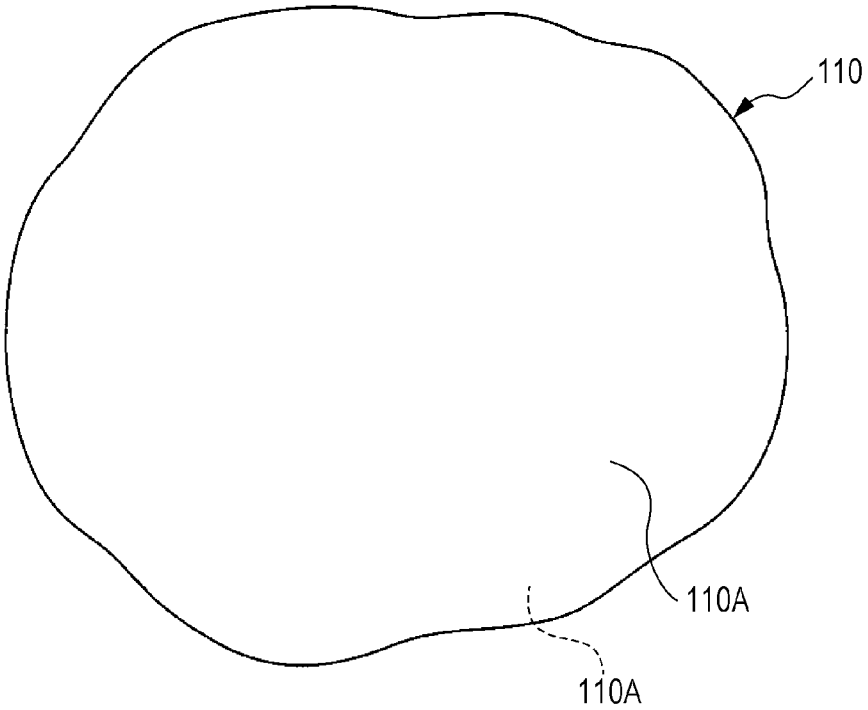
FIGS. 4A and 4B are a plan view and a side view, respectively, of a metallic pigment contained in a metallic toner used in the image forming apparatus according to the first exemplary embodiment of the present invention.
Figure 4B:
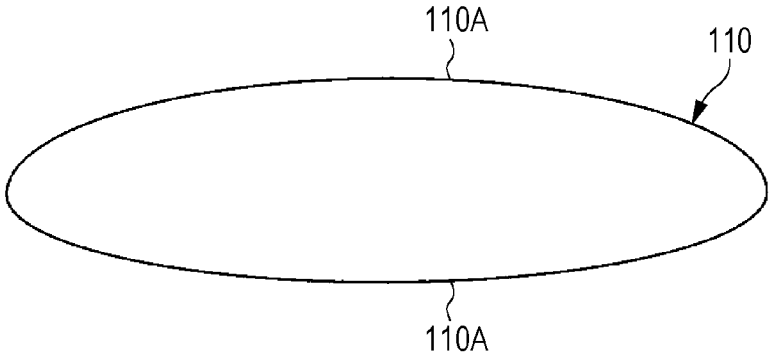

Furthermore, if the pigment 110 shown in FIG. 4B is viewed from above, as shown in FIG. 4A, the pigment 110 is wider than that as viewed from the side. The pigment 110 placed on a flat surface (see FIG. 4B) has a pair of reflection surfaces 110A (flat surfaces) facing up and down. In this manner, the pigment 110 is flat.

Note that the other toners used as the second special color (W), yellow (Y), magenta (M), cyan (C), and black (K) include pigment (for example, organic or inorganic pigment) that does not contain flat metallic pigment, and binder resin.

Other Configurations

As shown in FIGS. 2 and 1A, grounded rollers 72 that are grounded and are in contact with the back surface of the transfer belt 31 to support the transfer belt 31 are provided on the downstream side, in the rotation direction of the transfer belt 31, of the transfer portions 74 for the respective colors. The grounded rollers 72 serve as so-called surface lifting rollers.

As has been described above, due to the transfer currents flowing from the first transfer rollers 33 to the photoconductor drums 21, the transfer belt 31 is positively charged, causing negatively charged toner to be transferred to the positively charged transfer belt 31. However, because the grounded rollers 72 that are in contact with the back surface of the transfer belt 31 are grounded, the charge of the transfer belt 31 escapes through the grounded rollers 72. Hence, the positive charge amount at portions of the transfer belt 31 in contact with the grounded rollers 72 is small (decreases). Furthermore, because the electrical conductivity of the toner particles 112 containing the metallic pigment 110 is higher than that of toner not containing metallic pigment, the negative charge amount of the toner particles 112 is small. Therefore, the toner particles 112 containing the metallic pigment 110 may be scattered over the transfer belt 31 when passing the portion of the transfer belt 31 that is in contact with the grounded roller 72V, which is an example of a support member and is disposed on the downstream side of the transfer portion 74V for silver.

Now, scattering of the toner particles 112 containing the metallic pigment 110 that have been transferred to the transfer belt 31 will be described by comparing an image forming apparatus 200 according to a comparative example and the image forming apparatus 10 according to this exemplary embodiment.

Figure 1B:
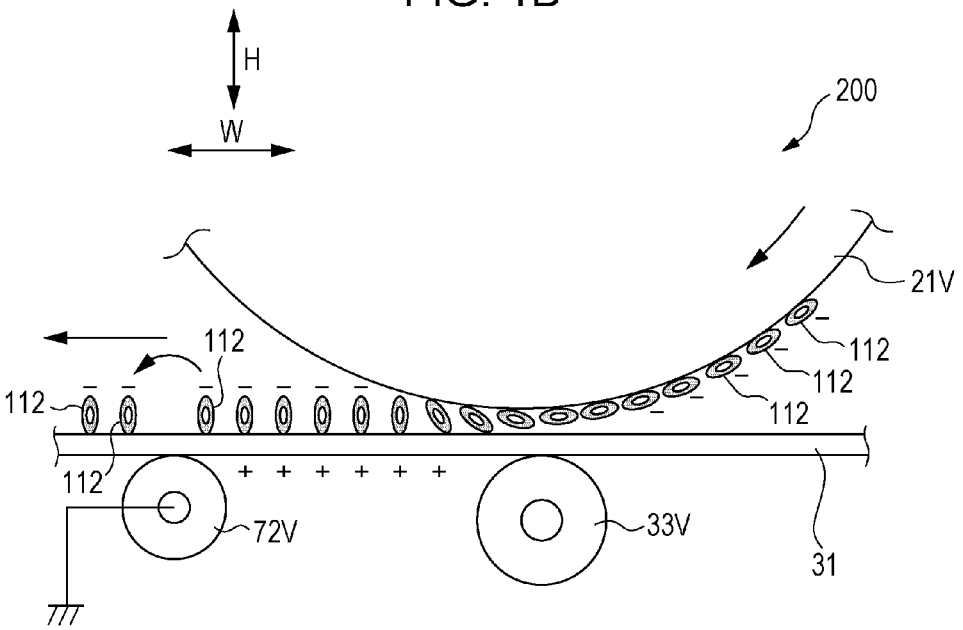

In the image forming apparatus 200 according to the comparative example, the transfer portion 74V for silver is located on the most upstream side of all the transfer portions 74 in the rotation direction of the transfer belt 31. Hence, as shown in FIG. 1B, a portion of the transfer belt 31 that has no static electricity after removal of static electricity by a static eliminating member (not shown) is charged for the first time when facing the first transfer roller 33V.

Because a portion of the transfer belt 31 to which the toner particles 112 are transferred has faced the first transfer roller 33 only once, the charge amount of that portion is smaller than that in a case where that portion has faced the first transfer roller 33 more than once. Therefore, the toner particles 112 transferred to the transfer belt 31 are scattered over the transfer belt 31 when passing the grounded roller 72V. In particular, because the toner particles 112 are flat, the contact area between the toner particles 112 and the transfer belt 31 is small when the toner particles 112 are standing upright on the transfer belt 31, as shown in FIG. 1B, compared with a state in which the toner particles 112 lie flat. Thus, the toner particles 112 are easily scattered over the transfer belt 31.

In contrast, in the image forming apparatus 10 according to the exemplary embodiment, the transfer portions 74 for the other colors are disposed on the upstream side of the transfer portion 74V for silver in the rotation direction of the transfer belt 31. In this exemplary embodiment, the transfer portion 74V for silver is disposed on the most downstream side of all the transfer portions 74 in the rotation direction of the transfer belt 31. Therefore, as shown in FIG. 1A, a portion of the transfer belt 31 that has already been positively charged is further charged by a transfer current when facing the first transfer roller 33V.

Because a portion of the transfer belt 31 to which the toner particles 112 are transferred has faced the first transfer rollers 33 several times, the charge amount of that portion is greater than that in a case where that portion has faced the first transfer roller 33 only once. Therefore, scattering of the toner particles 112 transferred to the transfer belt 31 over the transfer belt 31, occurring when passing the grounded roller 72V, is suppressed.

Evaluation

Next, scattering of toner over the transfer belt 31 is evaluated while changing the position of the transfer portion 74V for silver.

Position of Evaluation

Figure 3A:
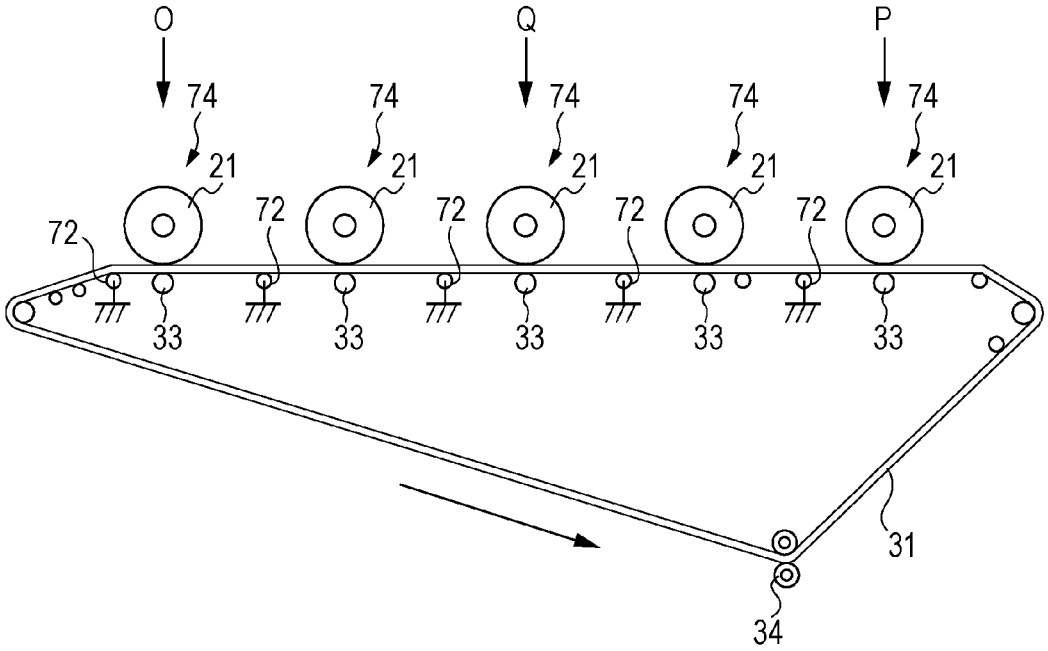
FIGS. 3A and 3B respectively are a diagram showing the configuration of the transfer portion, a transfer belt, etc. that are used to evaluate an image forming apparatus according to the first exemplary embodiment of the present invention, and a diagram showing the evaluation results.

As shown in FIG. 3A, five transfer portions 74 are provided along the transfer belt 31, and the transfer portion 74V for silver is disposed at the position described below. Note that the transfer portions 74 shown in FIG. 3A are illustrated only with the photoconductor drums 21 and the first transfer rollers 33; illustration of the other members is omitted.

(1) Comparative Example

The transfer portion 74V is disposed on the most upstream side in the rotation direction of the transfer belt 31 (i.e., the position on the extreme right side in FIG. 3A (Position P)).

(2) First Exemplary Embodiment

The transfer portion 74V is disposed as the third transfer portion from the upstream end in the rotation direction of the transfer belt 31 (i.e., the middle position in FIG. 3A (position Q)).

(3) Second Exemplary Embodiment

The transfer portion 74V is disposed on the most downstream side in the rotation direction of the transfer belt 31 (i.e., the position on the extreme left side in FIG. 3A (position O)).

Conditions and Specifications of Evaluation

1. Environment
   Temperature/Humidity: 28 [° C.]/85 [%RH]
2. First Transfer Roller
   Outside Diameter: ϕ28 [mm]
   Roller Resistance When a Voltage of 1000 [V] Is Applied: 7.7 [Log Ω]
   First Transfer Current: 45 [μA]
   Metal Shaft Covered with a Conducting Rubber Layer
3. Intermediate Transfer Belt
   Volume Resistance When a Voltage of 500 [V] Is Applied: 12.0 [Log Ω·cm] (measured using a UR probe)
   Seamless Belt Composed of Polyimide and Carbon Black Dispersed Therein
4. Grounded Roller
   Outside Diameter: 18 [mm]
   Material: Aluminum Method of Evaluation 1. Toner is recovered from the transfer belt after passing the grounded roller. More specifically, toner on the transfer belt is recovered by using a transparent tape (Scotch "Toumei bishoku" (manufactured by Sumitomo 3M Limited)).
2. A piece of transparent tape to which toner is adhered is attached to a coated paper (OS coated paper W 127 [g/m$^2$]).
3. The piece of transparent tape attached to the coated paper is scanned by using a scanner (EPSON ES-10000G) and is converted into image data (resolution: 400 dpi, BMP).
4. The image data is converted into two-gradation image data to obtain the scattering area of the toner (the amount of toner scattered).

Evaluation Results

Figure 3B:
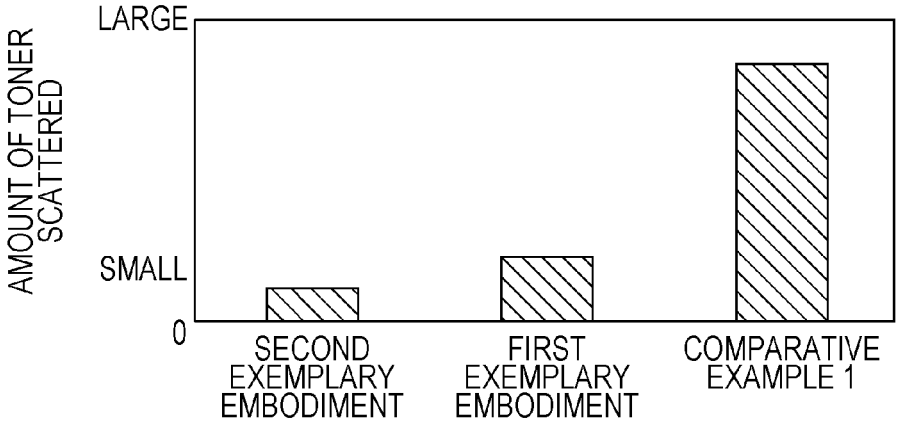

The evaluation results are shown in a bar chart in FIG. 3B. The vertical axis of the bar chart shows the amount of toner scattered as a result of using the grounded roller 72V.

As shown in FIG. 3B, the amount of toner scattered decreases in sequence of Comparative Example 1, the first exemplary embodiment, and the second exemplary embodiment. That is, the amount of toner scattered is largest in Comparative Example 1 and is smallest in the second exemplary embodiment.

Summary of the Configuration of the Relevant Part

As is understood from the evaluation results above, due to the portion of the transfer belt 31 to which the silver toner particles 112 are transferred facing the first transfer rollers 33 several times, the charge amount of that portion increases. Hence, scattering of the toner particles 112 transferred to the transfer belt 31 over the transfer belt 31, occurring when passing the grounded roller 72V, is suppressed.

In particular, by disposing the transfer portion 74V on the most downstream side, scattering of the toner particles 112 transferred to the transfer belt 31 is effectively suppressed.

Second Exemplary Embodiment

Next, an example of a transfer device and image forming apparatus according to a second exemplary embodiment of the present invention will be described with reference to FIG. 7. Note that the same components as those of the first exemplary embodiment will be denoted by the same reference numerals, and a description thereof will be omitted; a configuration different from that of the first exemplary embodiment will be described.

Figure 7:
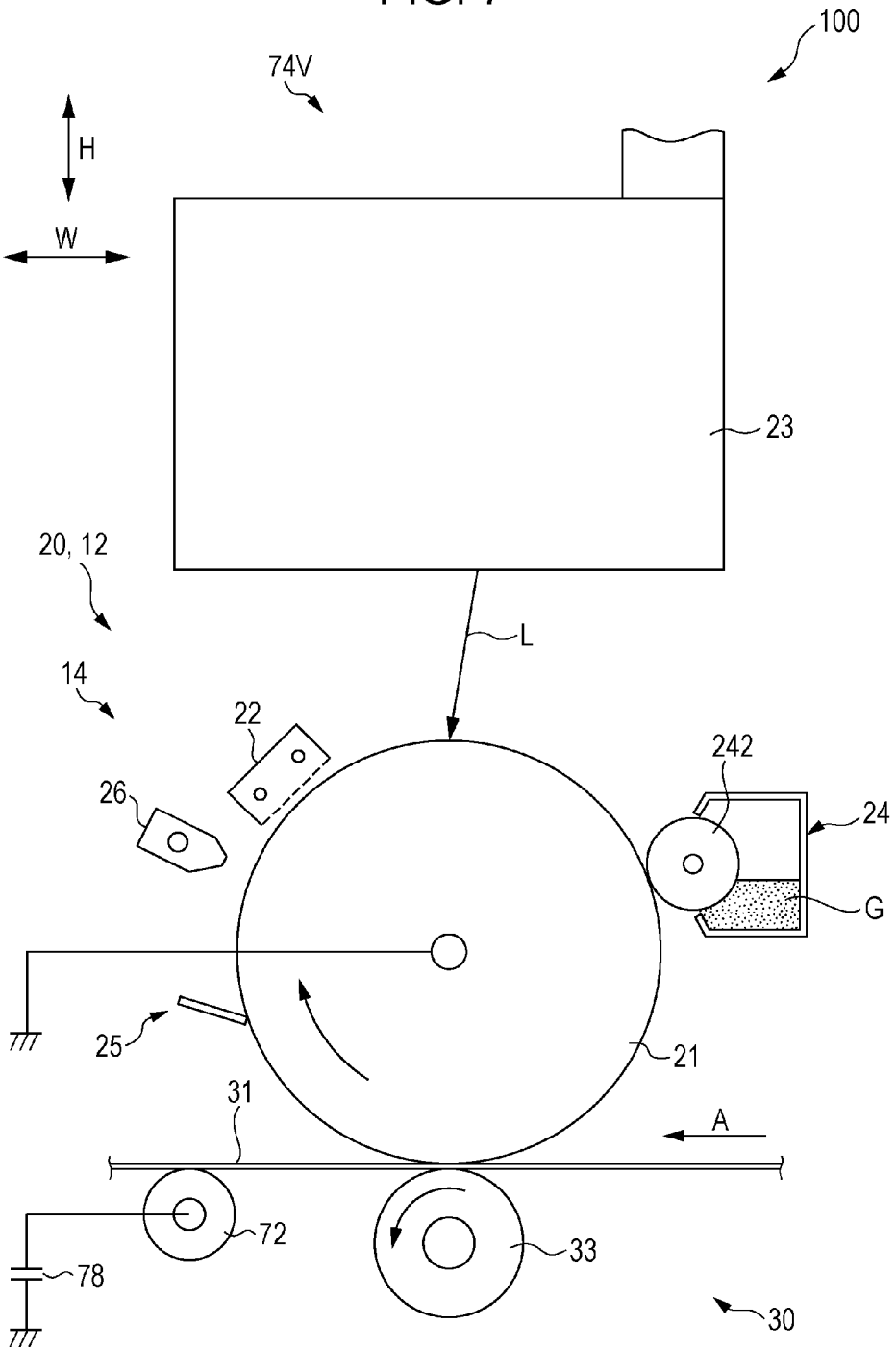
FIG. 7 is a diagram showing the configuration of a transfer portion etc. of a transfer device according to a second exemplary embodiment of the present invention.

As shown in FIG. 7, an image forming apparatus 100 according to the second exemplary embodiment includes a resistor 78. The grounded roller 72V is grounded via the resistor 78.

Due to this configuration, the charge amount of the transfer belt 31 escaping through the grounded roller 72V is smaller than that in the case without the resistor 78. Thus, scattering of the toner particles 112 transferred to the transfer belt 31 over the transfer belt 31 when passing the grounded roller 72V is effectively suppressed.

Note that the resistor 78 is provided to achieve high-resistance grounding, and has an electric resistance of, for example, 20 [MΩ] or more.

Third Exemplary Embodiment

Next, an example of a transfer device and image forming apparatus according to a third exemplary embodiment of the present invention will be described with reference to FIG. 8. Note that the same components as those of the first exemplary embodiment will be denoted by the same reference numerals, and a description thereof will be omitted; a configuration different from that of the first exemplary embodiment will be described.

Figure 8:
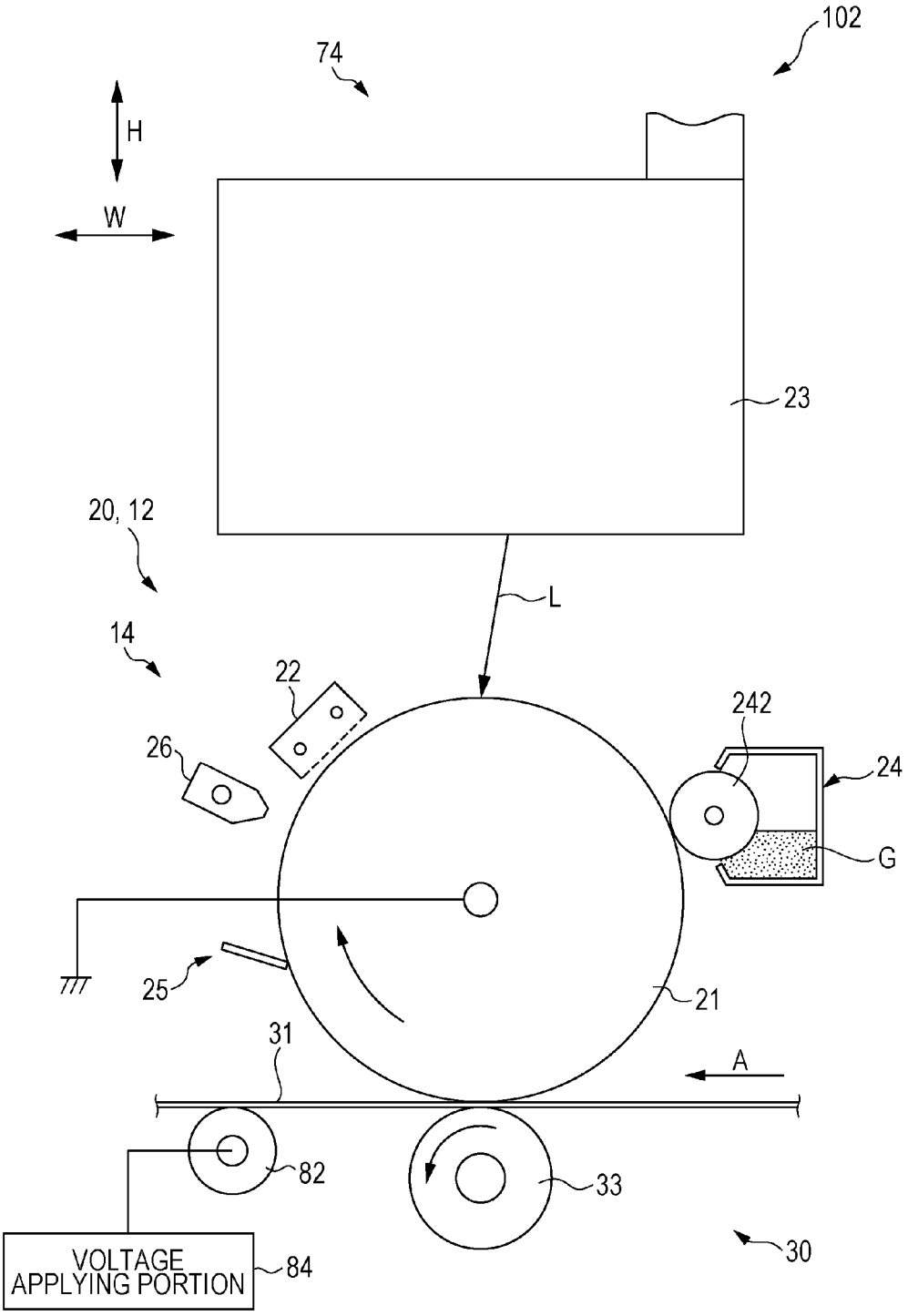
FIG. 8 is a diagram showing the configuration of a transfer portion etc. of a transfer device according to a third exemplary embodiment of the present invention.

As shown in FIG. 8, an image forming apparatus 102 according to the third exemplary embodiment includes a support roller 82, which is an example of a support member, that comes into contact with the back surface of the transfer belt 31 to support the transfer belt 31.

More specifically, the support roller 82 that comes into contact with the back surface of the transfer belt 31 to support the transfer belt 31 is provided on the downstream side of the transfer portion 74V (an example of the first transfer portion) in the rotation direction of the transfer belt 31. This support roller 82 serves as a so-called surface lifting roller.

The image forming apparatus 102 further includes a voltage applying portion 84 that applies, to the support roller 82, such a voltage that causes the toner particles 112, containing the pigment 110, to be electrostatically attracted to the transfer belt 31 (i.e., a positive voltage: a voltage having the opposite polarity to the charged toner).

Thus, scattering of the toner particles 112 transferred to the transfer belt 31 over the transfer belt 31 when passing the support roller 82 is effectively suppressed.

Furthermore, the transfer portion 74V is disposed on the downstream side of the transfer portions 74 for the other colors in the rotation direction of the transfer belt 31. Thus, the voltage applied to the support roller 82 to suppress scattering of the toner particles 112 over the transfer belt 31 is smaller than that in a case where the transfer portion 74V is disposed on the upstream side of the transfer portions 74 for the other colors.

Although specific exemplary embodiments of the present invention have been described in detail, the present invention is not limited to these exemplary embodiments, and it is obvious for those skilled in the art that various other exemplary embodiments are possible within a scope of the present invention. For example, the number of the transfer portions 74 for the other colors, which is more than one in the first and second exemplary embodiments, may be one.

Furthermore, although the transfer portion 74V for silver is disposed on the most downstream side in the rotation direction of the transfer belt 31 in the first and second exemplary embodiments, it is only necessary that at least one of the transfer portions 74 for the other colors is disposed on the upstream side of the transfer portion 74V for silver in the rotation direction of the transfer belt 31.

Furthermore, although the transfer portion 74V for silver is disposed on the most downstream side in the rotation direction of the transfer belt 31 in the third exemplary embodiment, the transfer portion 74V for silver may be disposed, for example, on the most upstream side in the rotation direction of the transfer belt 31, or it may be disposed at an intermediate position.

Furthermore, although the image forming apparatus 102 has the transfer portions 74 for the other colors in the third exemplary embodiment, the transfer portions 74 for the other colors do not necessarily have to be provided.

Furthermore, although the pigment 110 has a flat shape in the above-described exemplary embodiments, the pigment 110 may have another shape, such as, for example, a ball shape.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer body having an endless structure, wherein the transfer body is configured such that an image may be transferred to the transfer body while the transfer body is rotated;

a first transfer portion configured to transfer an image formed with toner containing metallic pigment to a surface of the transfer body by applying a first transfer current;

a second transfer portion that is disposed on an upstream side of the first transfer portion in a rotation direction of the transfer body, wherein the second transfer portion is configured to transfer an image formed with toner not containing metallic pigment to the surface of the transfer body by applying a second transfer current; and a support member that is grounded, wherein the support member is disposed on a downstream side of the first transfer portion in the rotation direction of the transfer body, and wherein the support member is in contact with a back surface of the transfer body to support the transfer body.

2. The transfer device according to claim 1, wherein the transfer device includes a plurality of the second transfer portions, and wherein all the second transfer portions are disposed on the upstream side of the first transfer portion in the rotation direction of the transfer body.

3. The transfer device according to claim 1, wherein the support member is grounded via a resistor.

4. The transfer device according to claim 1, wherein the metallic pigment is flat metallic pigment.

5. A transfer device comprising:

a transfer body having an endless structure, wherein the transfer body is configured such that an image may be transferred to the transfer body while the transfer body is rotated;

a first transfer portion configured to transfer an image formed with toner containing metallic pigment to a surface of the transfer body by applying a first transfer current; and a support member which is disposed on a downstream side of the first transfer portion in a rotation direction of the transfer body, the support member being in contact with a back surface of the transfer body, and to which a voltage having an opposite polarity to a polarity of the toner is applied, wherein the support member is provided without any directly opposing rollers on a front surface side of the transfer body.

6. The transfer device according to claim 5, further comprising a second transfer portion that is disposed on an upstream side of the first transfer portion in the rotation direction of the transfer body, wherein the second transfer portion is configured to transfer an image formed with toner not containing metallic pigment to the surface of the transfer body by applying a second transfer current.

7. The transfer device according to claim 6, wherein the transfer device includes a plurality of the second transfer portions, and wherein all the second transfer portions are disposed on the upstream side of the first transfer portion in the rotation direction of the transfer body.

8. The transfer device according to claim 5, wherein the metallic pigment is flat metallic pigment.

9. An image forming apparatus comprising:

the transfer device according to claim 1; and a medium transfer portion configured to transfer an image transferred to the transfer body of the transfer device to a recording medium.

10. The transfer device according to claim 1, wherein the second transfer portion, the first transfer portion and the support member are arranged sequentially along the rotation direction of the transfer body.

11. The transfer device according to claim 1, wherein the support member is provided without any directly opposing rollers on a front surface side of the transfer body.

12. The transfer device according to claim 1, wherein the support member is disposed at a position other than a position at which toner is transferred from the transfer body.

13. The transfer device according to claim 6, wherein the second transfer portion, the first transfer portion and the support member are arranged sequentially along the rotation direction of the transfer body.

14. A transfer device comprising:

a transfer body having an endless structure, wherein the transfer body is configured such that an image may be transferred to the transfer body while the transfer body is rotated;

a first transfer portion configured to transfer an image formed with toner containing metallic pigment to a surface of the transfer body by applying a first transfer current; and a support member which is disposed on a downstream side of the first transfer portion in a rotation direction of the transfer body, the support member being in contact with a back surface of the transfer body, and to which a voltage having an opposite polarity to a polarity of the toner is applied, wherein the support member is disposed at a position other than a position at which toner is transferred from the transfer body.

* * * * *